US010676909B2

(12) United States Patent
Jarrar

(10) Patent No.: US 10,676,909 B2
(45) Date of Patent: Jun. 9, 2020

(54) CONTAMINATION BARRIER FOR PLUMBING SYSTEMS AND METHOD OF USING SAME

(71) Applicant: Rebecca Jarrar, Houston, TX (US)

(72) Inventor: Mike Maan Jarrar, Houston, TX (US)

(73) Assignee: Rebecca Jarrar, Houston, TX (US)

( * ) Notice: Subject to any disclaimer, the term of this patent is extended or adjusted under 35 U.S.C. 154(b) by 168 days.

(21) Appl. No.: 15/821,424

(22) Filed: Nov. 22, 2017

(65) Prior Publication Data

US 2019/0153717 A1 May 23, 2019

(51) Int. Cl.

| | |
|---|---|
| ***E03F 3/04*** | (2006.01) |
| ***E03F 1/00*** | (2006.01) |
| ***E03F 3/02*** | (2006.01) |
| ***E03C 1/122*** | (2006.01) |
| ***E03C 1/284*** | (2006.01) |
| ***E03C 1/288*** | (2006.01) |
| ***E03F 5/02*** | (2006.01) |
| ***E03F 7/04*** | (2006.01) |

(52) U.S. Cl.

CPC ..... *E03F 3/04* (2013.01); *E03C 1/122* (2013.01); *E03C 1/284* (2013.01); *E03C 1/288* (2013.01); *E03F 1/006* (2013.01); *E03F 3/02* (2013.01); *E03F 5/02* (2013.01); *E03F 7/04* (2013.01)

(58) Field of Classification Search

None

See application file for complete search history.

(56) References Cited

U.S. PATENT DOCUMENTS

| | | | |
|---|---|---|---|
| 4,497,337 | A | 2/1985 | Mosbrucker |
| 4,603,680 | A | 8/1986 | Dempsey |
| 5,379,751 | A | 1/1995 | Larsen |
| 5,537,756 | A | 7/1996 | Haessner |
| 5,582,159 | A | 12/1996 | Harvey |

(Continued)

OTHER PUBLICATIONS

Horns, Vibrating, 118 and 123A Series [online]. Edwards Corporation, Published on a date prior to this application [retrieved on Oct. 22, 2017]. Retrieved from the Internet: <URL: https://edwards-signals.com/files/c-118_&_123A_Catalog_Page.pdf>.

(Continued)

*Primary Examiner* — Richard C Gurtowski

(74) *Attorney, Agent, or Firm* — Nolte Intellectual Property Law Group

(57) ABSTRACT

A contamination unit for isolating a building from contamination of a sewer is disclosed. The contamination unit includes a housing with an inlet and an outlet, a trap assembly, and a fluid trigger. The inlet is in fluid communication with a fluid source, plumbing equipment, and/or condensating equipment to receive fluid. The housing has a reservoir to collect the fluid therein and to define a reservoir portion of a contamination barrier about the outlet. The trap assembly includes a trap conduit between the outlet and the sewer that is shaped to collect the fluid therein and define a trap portion of the contamination barrier. The fluid trigger is positionable about the housing to selectively release the fluid through the inlet and into the reservoir of the housing whereby the fluid in the contamination barrier is maintained to prevent the contamination from passing from the sewer into the building.

20 Claims, 13 Drawing Sheets

(56) References Cited

U.S. PATENT DOCUMENTS

| | | | | |
|---|---|---|---|---|
| 5,826,609 | A * | 10/1998 | Watts | E03F 5/02 137/15.17 |
| 5,911,742 | A | 6/1999 | Akazawa | |
| 6,152,164 | A | 11/2000 | Whiteside | |
| 6,321,554 | B1 | 11/2001 | Rigoni | |
| 6,442,956 | B1 * | 9/2002 | Herren | F24F 13/222 62/150 |
| 2012/0090591 | A1 | 4/2012 | Rieke | |
| 2012/0090601 | A1 | 4/2012 | Ramasamy | |

OTHER PUBLICATIONS

Lead-Free Copper Alloy Ball. Datasheet [online]. KITZ Corporation, Published on a date prior to this application [retrieved on Oct. 6, 2017]. Retrieved from the Internet: <URL: https://www.kitzus-kca.com/pdfs/Commercial/Ball/Lead%20Free/868M_869M.pdf>.

PR-500 Pressure Drop Activated Trap Primer Submittal [online]. JL Industries, Inc., Published on a date prior to this application [retrieved on Oct. 6, 2017]. Retrieved from the Internet: <URL: http://www.pppinc.net/2/submittals/TPV_Prime_Rite_150.pdf>.

Solenoid Valves / 2-way, Normally Closed / Series I / I5U29-00V Technical Spec [online]. Granzow Inc., Published on a date prior to this application [retrieved on Nov. 17, 2017]. Retrieved from the Internet: <URL: http://www.granzow.com/valves/solenoid/I5U29-00V/>.

Amazon: PPP P1-500 P-1 Primer Automatic Trap Primer Valve [online]. JL Industries, Inc., Published on a date prior to this application [retrieved on Oct. 24, 2017]. Retrieved from the Internet: <URL: https://www.amazon.com/PPP-P1-500-Primer-Automatic-Valve/dp/B003BLH9B8>.

RedHat—120VAC Brass Solenoid Valve, Normally Closed, ½" Pipe Size Technical Specs [online]. Grainger Inc., Published on a date prior to this application [retrieved on Nov. 17, 2017]. Retrieved from the Internet: <URL: https://www.grainger.com/product/3UK51?cm_mmc=PPC:+Google+PLA&s_kwcid=AL!2966!3!50916684477!!49 g!64218549921!&ef_id=WYNBqwAABCHfDtXn:20171117183017:s&kwid=productads-adid/^50916684477-device/^c-olaid/^64218549921-sku/^3UK51-adType/^PLA>.

Trap Guard Product Drawings (T25630-F-CI—2" Adj. NB FD w/mechanical hub joint for C.I.) [online]. ProVent Systems Inc., Published on a date prior to this application [retrieved on Nov. 6, 2017]. Retrieved from the Internet: <URL: http://proventsystems.com/product-solution/trap-guard/product-drawings/>.

* cited by examiner

CONTAMINATION BARRIER FOR PLUMBING SYSTEMS AND METHOD OF USING SAME

BACKGROUND

This present disclosure relates generally to building facilities. More specifically, the present disclosure relates to building plumbing systems and contamination prevention techniques for use therewith.

Buildings, such as schools, have building facilities, such as plumbing systems, HVAC (heating ventilation, and air conditioning) systems, power systems, communication systems, and security systems. These plumbing systems include a water system to transport water from a fluid source to parts of the building, such as restrooms and kitchens, for use therein. The water system includes a network of pipes to transport the water about the building. An example of a water system is provided in U.S. Pat. No. 7,308,906, the entire contents of which are hereby incorporated by reference herein.

The plumbing system also includes a sewer system to transport sewage away from parts of the building, such as restrooms and kitchen sinks. The sewer system includes a network of drainage pipes to transport the sewage from the building and to a sewer. An example sewer system is provided in U.S. Pat. No. 6,243,887, the entire contents of which are hereby incorporated by reference herein.

Despite the advancements in plumbing systems, there remains a need to prevent contamination in the building. The present disclosure is intended to provide such needs.

SUMMARY

In one aspect, the disclosure relates to a contamination unit for isolating a building from contamination of a sewer. The contamination unit includes a housing with an inlet and an outlet, a trap assembly, and a fluid trigger. The inlet is in fluid communication with a fluid source, plumbing equipment, and/or condensating equipment to receive fluid. The housing has a reservoir to collect the fluid therein and to define a reservoir portion of a contamination barrier about the outlet. The trap assembly includes a trap conduit between the outlet and the sewer that is shaped to collect the fluid therein and define a trap portion of the contamination barrier. The fluid trigger selectively releases the fluid into the housing, and is activatable in responsive to an amount of the fluid in the reservoir whereby the fluid in the contamination barrier is maintained to prevent the contamination from passing from the sewer into the building.

The fluid trigger comprises a solenoid and/or a primer. The housing comprises a front plate with an access door. The inlet comprises a water inlet operatively connected to the fluid source and/or the plumbing equipment, and a condensation inlet operatively connected to the condensating equipment. The contamination unit further comprises a power/communication unit supported in the housing, and is operatively connected to power/communication equipment of the building and/or a power/communication source. The contamination unit further comprises an alarm operatively connected to the power/communication unit.

The contamination unit further comprises a fluid sensor positionable about the reservoir to measure fluid parameters thereof. The fluid sensor comprises a float sensor. The contamination unit further comprising a power/communication unit operatively coupled to the fluid sensor to receive the fluid parameters therefrom and to the fluid trigger. The power/communication unit comprises a processor to selectively activate the fluid trigger to release the fluid based on the fluid parameters. The contamination unit further comprises a power/communication unit supported in the housing, and operatively connected to the fluid trigger to send activation signals thereto.

The trap assembly further comprises a trap positioned in the trap conduit. The trap assembly further comprises a trap seat shaped to sealingly support the trap therein. The trap seat comprises a shoulder and/or a dimple. The contamination unit is operatively connectable to the sewer, the plumbing equipment, the fluid source, and/or the condensating equipment by portions of a plumbing system.

In another aspect, the disclosure relates to a contamination system for isolating a building from contamination of a sewer. The building comprises plumbing, condensating, and power/communication equipment. The plumbing equipment and/or the condensating equipment are each in fluid communication with a fluid source to receive a fluid therefrom. The contamination system comprises a plurality of contamination units. Each of the contamination units comprises a housing with an inlet and an outlet, a trap assembly, a fluid trigger, and a power/communication unit. The inlet is in fluid communication with a fluid source, plumbing equipment, and/or condensating equipment to receive fluid. The housing has a reservoir to collect the fluid therein and to define a reservoir portion of a contamination barrier about the outlet. The trap assembly includes a trap conduit between the outlet and the sewer that is shaped to collect the fluid therein and define a trap portion of the contamination barrier. The fluid trigger is positionable about the housing to selectively release the fluid through the inlet and into the reservoir of the housing. The power/communication unit is communicatively coupled to the contamination units to selectively signal the fluid trigger whereby the fluid in the contamination barrier is maintained to prevent the contamination from passing from the sewer into the building.

The power/communication unit is communicatively coupled to a power/communication equipment of the building. The contamination system may further comprise a fluid sensor positionable in the reservoir, the power/communication unit coupled to the fluid sensor to receive fluid parameters therefrom.

Finally, in another aspect, the disclosure relates to a method of isolating a building from contamination of a sewer. The building has building facilities comprising a fluid source, plumbing equipment, and condensing equipment. The method comprises positioning contamination units about a building. The contamination units comprise a housing with a reservoir and a trap assembly with a deviation. The method further comprises selectively passing fluid from the building facilities through the housing and the trap of the contamination units, and to a sewer, and inhibiting contamination from passing from the sewer back into the building through the contamination units by defining a contamination barrier by collecting a portion of the fluid in the reservoir of the housing and a portion of the fluid in the deviation of the trap assembly.

The method may further comprise measuring fluid parameters of the fluid in the reservoir and/or maintaining the contamination barrier by performing the selectively passing based on the measured parameters. The selectively passing may comprise releasing the fluid according to predefined time intervals.

BRIEF DESCRIPTION OF THE DRAWINGS

So that the features herein can be understood in detail, a more particular description may be had by reference to the embodiments thereof that are illustrated in the appended drawings. It is to be noted, however, that the examples illustrated are not to be considered limiting of its scope. The figures are not necessarily to scale and certain features and certain views of the figures may be shown exaggerated in scale or in schematic in the interest of clarity and conciseness.

DETAILED DESCRIPTION

In the following description, numerous details are set forth to provide an understanding of the present disclosure. However, it will be understood by those skilled in the art that the present disclosure may be practiced without these details and that numerous variations or modifications from the described embodiments are possible.

The present disclosure relates to a contamination system for providing a barrier to isolate a building from contamination. The contamination system is fluidly connected to the building's plumbing system between the building's water and sewer systems to create a contamination barrier including a contamination unit that isolates the building from the contamination of the sewer system. The contamination unit may include a housing with inlets to receive fluid from the water system and/or other fluid sources, and an outlet to pass the fluids to the sewer system.

The contamination may be in the form of solid, liquid, and/or gas and may include waste water, sewage, and/or other materials that pass from the building's facilities and to the sewer. Such contamination may be passed to various sewers, such as public or private water treatment plants, septic tanks, and/or other on or offsite sewage facilities and/or portions thereof. Exposure to such contaminants may case foul odors, mold, bacteria, and/or other "contamination issues".

Figure 2:
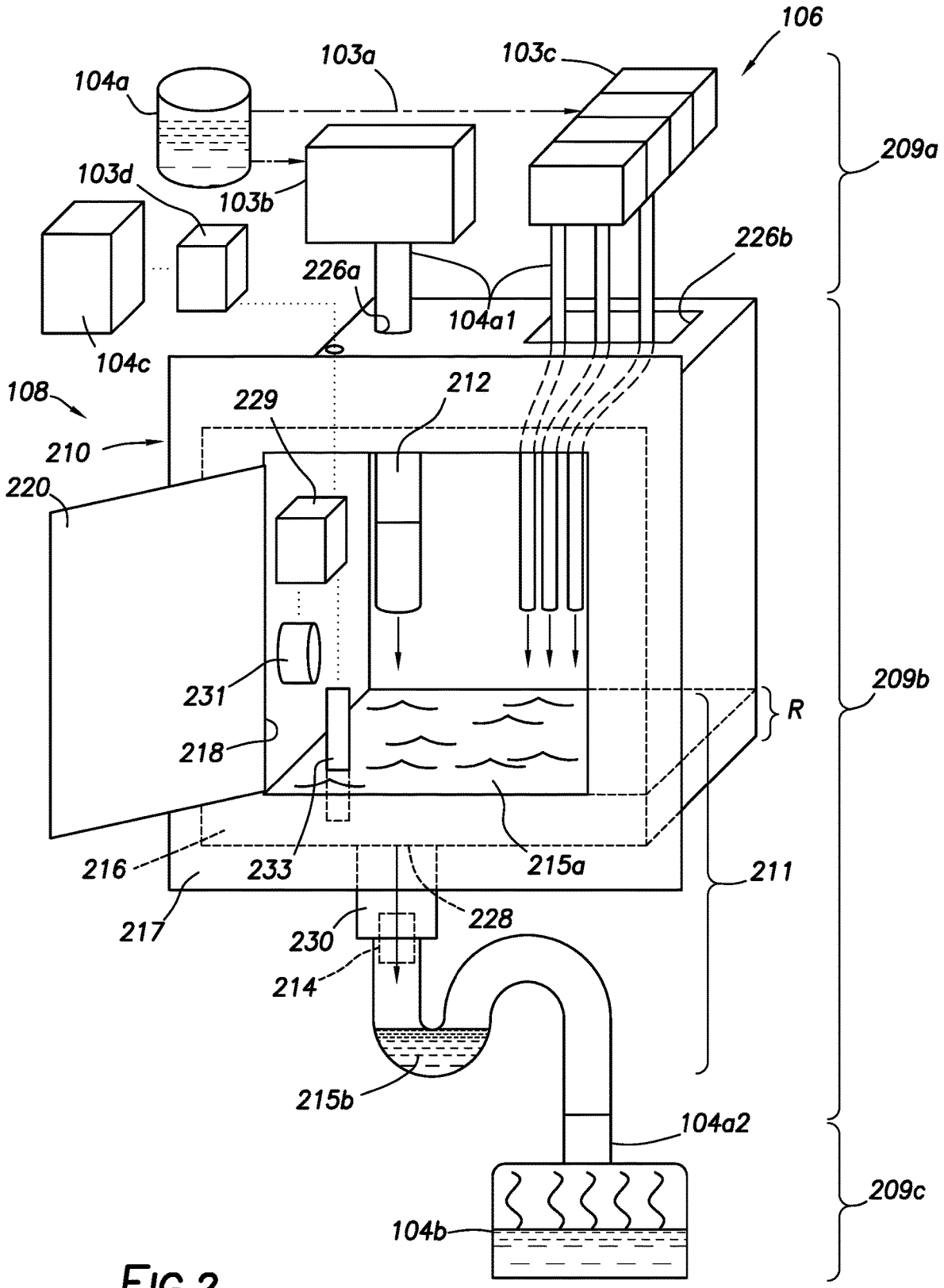
FIG. 2 is a schematic view of the contamination system.

The contamination units are located about the building and connected to portions of the plumbing system. The contamination units allow the passage of fluid from various fluid sources to the sewer system, while using the same fluid to form the contamination barrier to block contaminants from passing from the sewer system back into the building. As illustrated in FIG. 2 and explained further below, the contamination units include a housing to provide a first portion and a trap to provide a second portion that each collect the fluid to form redundant portions of the contamination barrier (which, when configured as disclosed herein, may be referred to as a "redundant contamination barrier"), and a fluid trigger to selectively provide fluid to the contamination barrier. The housing also provides an access point for maintenance. The contamination system of this disclosure seeks to provide one or more of the following: use with existing plumbing equipment, compact assembly, easy access to components, flexibility (e.g., in positioning about a building), modularity, movability, selective placement, timed operation, redundant barriers to contamination (hence the term "redundant contamination barrier"), prevention of exposure to contaminants and/or contamination issues, isolation of the building from sewer systems, continuous or regular fluid supply to components, increased duration and/or protection of components, etc.

Figure 1:
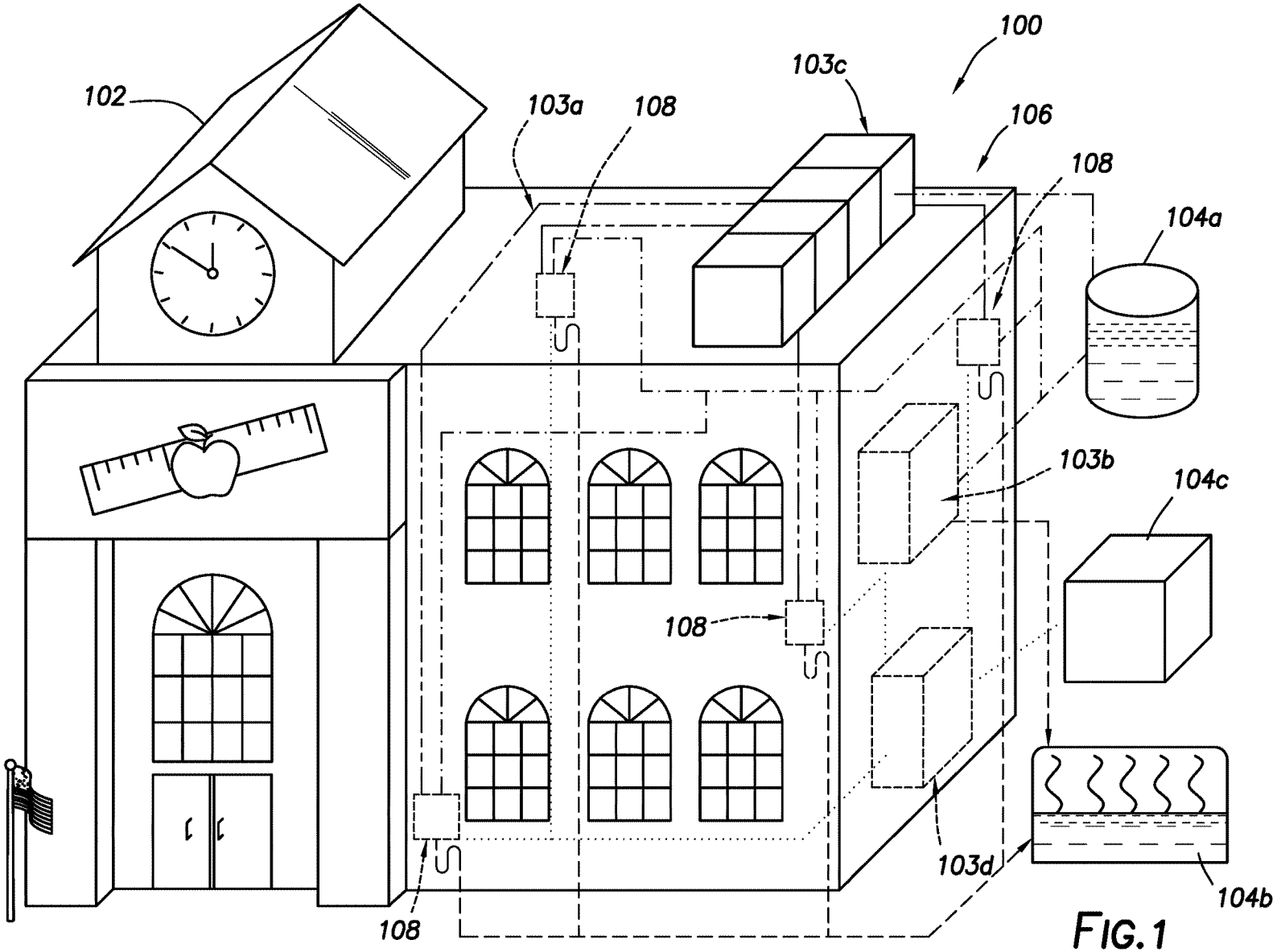
FIG. 1 is a schematic view of a building site with a building, building facilities, and a contamination system.

FIG. 1 is a schematic diagram of a building site 100 that includes a building 102 with a contamination system 106. The building 102 is provided with various facilities, such as a plumbing system 103*a*, plumbing equipment 103*b* (e.g., toilets, faucets, drinking fountains, sprinkler systems, refrigerators, etc.), condensating equipment 103*c* (e.g., HVAC, water heaters, etc.), and a power/communication equipment 103*d* (electricity/power, lighting, computers, security, etc.), and/or other building equipment for performing various building operations. While a certain configuration of the building 102 and its facilities are depicted, various arrangements and/or locations of equipment and/or building structures may be provided.

The plumbing system 103*a* may pass fluids, such as water, to, from, and about parts of the building 102 for use with the various building facilities. The plumbing system 103*a* includes a network of pipes (e.g., tubes, conduits, cylinders, ducts, and/or other tubular members made of plastic, metal, or other material capable of passing fluid therethrough and connecting to other parts of the building 102) and other fluid control devices (e.g., valves, drains, pumps, restrictors, water heaters, etc.) capable of controlling flow of fluid through the pipes. A water portion of the plumbing system 103*a* is connectable to a fluid (e.g., water) source 104*a*, and a sewer portion of the plumbing system 103*a* may be connectable to a sewer 104*b*. The water portion may be fluidly connected to the fluid source 104*a* for passing water to various parts of the building 102. The fluid source 104*a* may be one or more on or offsite sources of fluid, such as a well, water tank, access to government water, and/or other sources.

The water portion of the plumbing system 103*a* may pass water from the fluid source 104*a* to the plumbing equipment 103*b* to operate, for example, restrooms for human disposal, kitchens for cooking, and faucets for human consumption. The water portion of the plumbing system 103*a* may also pass water from the fluid source 104*a* to the condensating equipment 103*c* to operate, for example, HVAC units for heating and cooling air and/or water heaters for heating water.

Once used by the plumbing and condensating equipment 103*b,c*, the waste water and/or other waste (solid and/or liquid) become sewage, and may be passed to the sewer portion of the plumbing system 103*a*. The sewer portion of the plumbing system 103*a* may be used to pass the sewage out of the building 102. The sewer portion may include drains coupled to, or positioned about, the plumbing equipment 103*b* and/or the condensating equipment 103*c*. The sewer portion may pass the sewage from the equipment 103*b,c* out of the building 102 and to one or more of the sewer 104*b*.

The power/communication equipment 103*d* is coupled to a power/communication source 104*c*. The power/communication equipment 103*d* may be an electrical, optical, solar, mechanical, and/or other power source, and/or a network of computers, sensors, monitors, telephones, transceivers, alarms, and/or other communication devices, capable of performing power and/or communication functions. The power/communication source 104*c* may be an on or offsite facility publicly or privately owned, such as cables, cable systems, telecommunication systems, wires, wireless connections, conduits, power sources, generators, solar panels, batteries, electrical grids, fiber optic networks, and/or other devices used to provide power and/or communication capabilities to the building 102.

The power/communication equipment 103*d* may be wired or wirelessly connected with the power/communication source 104*c* for use about the building 102. For example, the power/communication equipment 103*d* may also be wired and/or wirelessly connected to the other building facilities, such as a lighting system, to provide power, and/or to the telephone and/or computer systems for communication with offsite facilities. The power/communication equipment 103*d* may also be used with other building facilities, such as the HVAC or other condensating equipment 103*c*, to provide power there and/or to control operation thereof.

The contamination system 106 may positioned about the building 102 to isolate the building 102 from contaminants in the sewer 104*b*. The contamination system 106 includes one or more contamination units 108 fluidly connected between the fluid source 104*a* and the sewer 104*b* to pass the fluid from the fluid source 104*a* to the sewer 104*b*. The contamination units 108 may be positioned at various locations about the building 102, such as about a wall, an equipment room, equipment housing, and/or about other locations of the building 102.

As shown in FIG. 1, the contamination units 108 may be fluidly connected to the plumbing equipment 103*b* and the condensating equipment 103*c* to receive the fluids (e.g., runoff fluids) therefrom. The contamination units 108 may also be fluidly connected to the sewer 104*b* to pass the sewage thereto. The contamination units 108 may be used to create a contamination barrier to isolate the building 102 from the contamination of the sewer 104*b* as is described further herein.

While a specific configuration of the building site 100 is depicted, various configurations may be provided. For example, while the building 102 is depicted as a school building, any residential or non-residential building (e.g. hospital, office building, apartment, home, etc.) may be used. The building 102 may have one or more levels and may contain one or more rooms, such as, restrooms, kitchens, offices, classrooms, basements, attics, mechanical rooms, equipment rooms, etc.

In another example, while a certain configuration of the facilities 103*a-d* and the fluid source 104*a*, the sewer 104*b*, and the building 102 are shown, various combinations of one or more features as shown may be used. While only one fluid source 104*a*, one sewer 104*b*, and one power/communication source 104*c* are shown, one or more such sources may be coupled to the building 102.

FIG. 2 schematically depicts the contamination system 106. As shown in this view, the system 106 is broken into three functional regions: an operational region 209*a*, a barrier region 209*b*, and a contamination region 209*c*. The regions 209*a-c* may include portions of the plumbing system 103*a*, and/or be coupled to portions of the plumbing system 103*a*, such as the water and the contamination portions 104*a*1,*a*2.

The operational region 209*a* includes the facilities that provide the inputs (e.g., water, condensating equipment, and power/communication) to the contamination unit 108. Various combinations of one or more inputs may be provided to the contamination unit 108. As shown in this example, the operational region 209*a* includes the fluid source 104*a*, as well as the plumbing equipment 103*b* and the condensating equipment 103*c*, both receiving the water from the fluid source 104*a*. The operational region 209*a* also includes the power/communication source 104*c*, as well as the power/communication equipment 103*d* receiving the power/communication therefrom. The contamination region 209*c* includes the sewer 104*b*. The contamination region 209*c* receives and houses the fluids released by the operational region 209*a*.

The barrier region 209*b* is defined between the operational region 209*a* and the contamination region 209*c*. The barrier region 209*b* includes the contamination unit 108. The contamination unit 108 seeks to use the fluid received from multiple portions of the operational region 209*a* to maintain a continuous contamination barrier 211 that prevents the contamination of the sewer 104*b* from passing back to the operational region 209*a*.

The contamination unit 108 is designed to receive the inputs, namely fluid, from the operational region 209*a* and pass the fluid to the sewer 104*b* of the contamination region 209*c* while isolating the operational region 209*a* from the contamination of the sewer 104*b*. This configuration is intended to provide a barrier region 209*b* that prevents contamination issues from passing from the contamination region 209*c* to the operational region 209*a* as is described further herein.

1. The Housing

The contamination unit 108 includes a housing 210, a fluid trigger 212, and a trap assembly 214. The housing 210 may be a container (e.g., box) positionable, for example, in a wall of the building 102. As shown, the container has a cuboid shape, but may be of various shapes capable of performing functions as part of the contamination barrier 211. The housing 210 may be made of various materials, such as metal, with or without seals, coatings, etc. Portions of the housing 210, such as the sides, the front, the back, the top, the bottom, the front face, etc., may be integrally formed, adhered, molded, welded, bonded, and/or secured together.

The housing 210 may have a front face (or cover) 216 that extends over the front of the housing 210. The front face 216 may have a rectangular shape that extends beyond a perimeter of the housing 210 to define a lip 217 to support the housing 210 against the wall. The front face 216 may be an integral with or separate from the remainder of the housing 210. The front face 216 may be adhered to the housing 210, for example, along adjacent edges of side, top, and bottom portions of the housing 210.

The front face 216 has an opening that leads to an internal chamber 218. The opening of the front face 216 may be a rectangular or other shape that extends a distance within a perimeter defined by the adjacent edges of the housing 210. An access door 220 may be positioned about the opening to selectively provide access to or seal about the opening of the chamber 218. The opening may be along the front face 216 a distance from a bottom of the housing 210 to define a reservoir R within the chamber 218. The reservoir R may be shaped to receive a volume of fluid for storage therein. The fluid in the reservoir R may provide a reservoir portion 215*a* of the contamination barrier 211 as is described further herein.

The housing 210 has an inlet 226*a* to receive fluid from, or for fluid connection to, the plumbing equipment 103*b* and/or the fluid source 104*a*. The inlet 226*a* may receive the fluid directly from the fluid source 104*a* and/or from runoff from the plumbing equipment 103*b*. The housing 210 also has an inlet 226*b* to receive fluid from, or for fluid connection to, the condensating equipment 103*c*. The inlets 226*a,b* may be connected to the equipment 103*b,c* via a water portion 104*a*1 of the plumbing system 103*a* and/or directly to the equipment 103*b,c*. The equipment 103*b,c* may have plumbing devices and/or portions that operate in place of, or with, the water portion 104*a*1 of the plumbing system 103*a*.

The housing 210 has an outlet 228 for fluid connection to the sewer 104*b* by the trap assembly 214. The trap assembly 214 receives fluid from the reservoir R to provide a trap portion 215*b* of the contamination barrier 211 as is described further herein. The outlet 228 may be positioned at a bottom of the housing 210. The outlet 228 may include or be connected to a tube 230 extending from the bottom of the housing 210. One or more inlets and/or outlets with or without tubes, seals, and/or other features may be provided.

While the inlets 226*a-c* and outlet 228 are depicted in specific locations, the inlets 226*a-c* and outlet 228 may be located at various locations of the contamination housing 210. The inlets and outlets 226*a-c*, 228 may be provided with connectors for connection to the plumbing system 103*a*, the equipment 103*b,c*, the sewer 104*b*, and/or other parts of the contamination system.

The chamber 218 of the housing is defined along inner surfaces thereof. The inner surfaces may be used to support equipment, such as power/communication unit 229, an alarm 231, a sensor 233, and/or other components usable with the contamination unit 108. An inlet 226*c* may be provided for receiving a connection (e.g., cables, conduits, wiring, etc.) for connection between the power/communication unit 229 within the housing 210 and the power/communication equipment 103*d* outside of the housing 210.

Figure 3A:
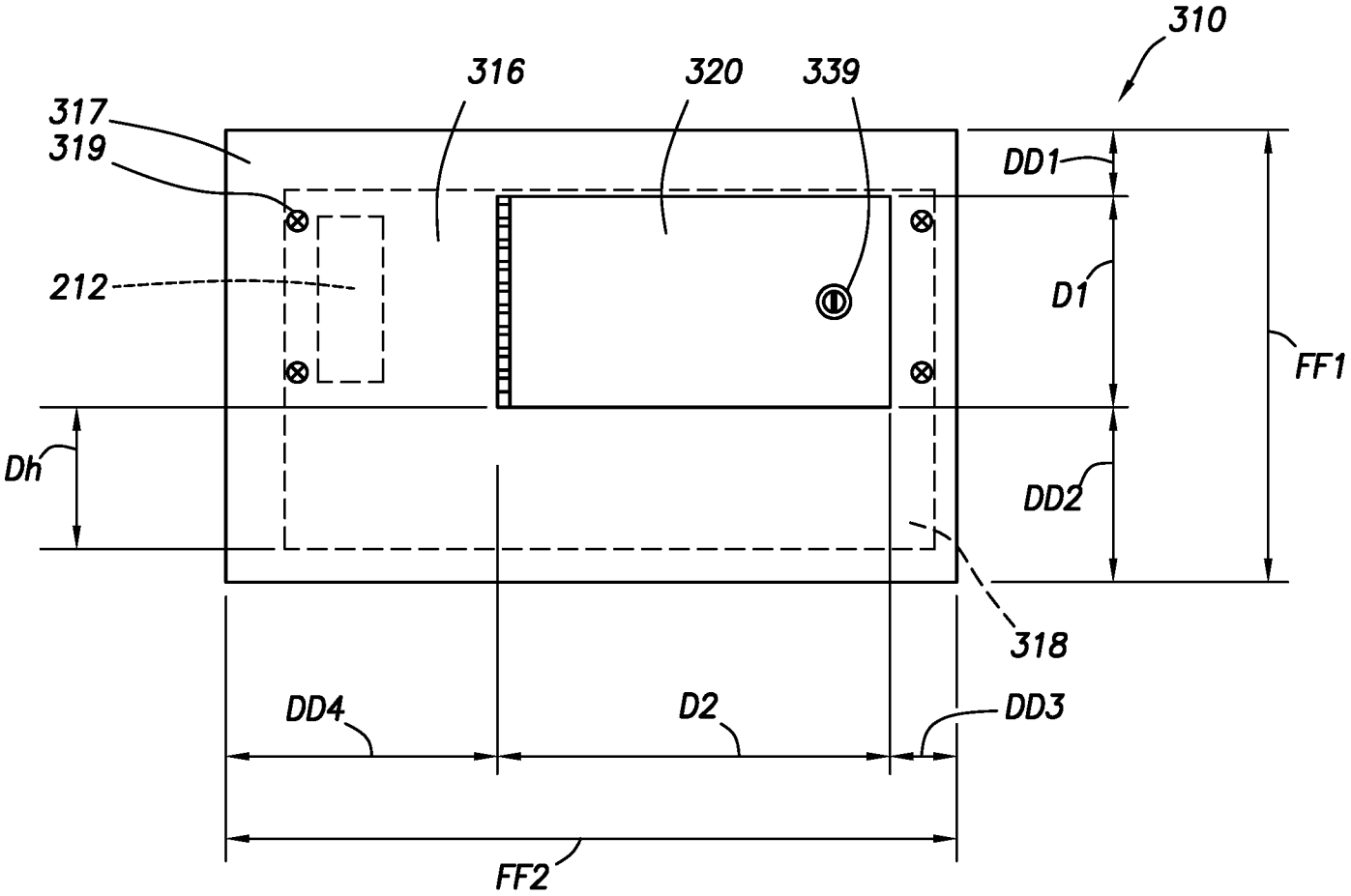
FIGS. 3A-3C are various views of portions of an example contamination unit.

Referring to FIGS. 2 and 3A-4C, various configurations of housings 210, 310, 410, may be used. Example housings 310, 410 are shown in FIGS. 3A-C and 4A-C, respectively. These housings 310, 410 may be similar to the housing 210, with additional details and features that may be used. FIGS. 3A-C show the housing 310 in a first configuration with a single inlet and an elongated shape.

FIG. 3A shows dimensions of the front face 316 and the door 320. The front face 316 has a rectangular shape with dimensions FF1×FF2. As shown by the dashed line, the front face 316 extends a distance outside the chamber 318 of the housing to define the lip 317. In this example, each of the distances of the lip 317 along each side are different, but optionally may be similar. The front face 316 is removably secured to a front of the housing 310 by fasteners 319 (e.g., screws, bolts, rivets, bonding, magnets, etc.).

The door 320 is positioned along the front face 316 about an upper right portion thereof within the perimeter of the chamber 318 (defined by the dashed lines). The door 320 has a rectangular shape with dimensions D1×D2. The door 320 is positioned a distance DD1-DD4 from each edge of the front face 316. The door 320 is also positioned a distance Dh from a bottom of the housing 310. The door 320 may be removably attached to the front face by a hinge. A vertical side of the door 320 is connected to the front face 316 by the hinge to allow the door 320 to pivot open to reveal the chamber 318. A lock 339 is provided to secure the door 320 in a closed position.

Figure 3B:
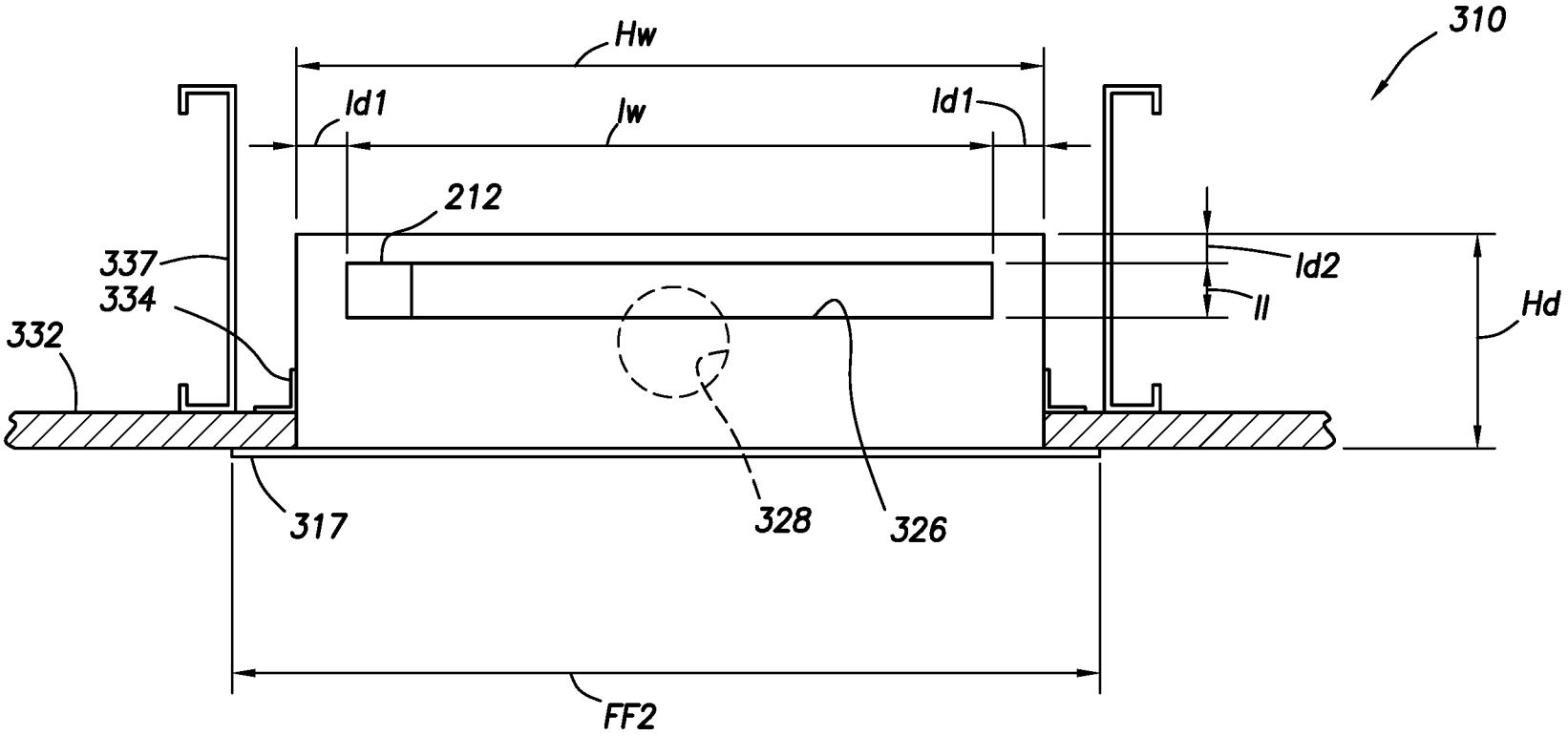

FIG. 3B shows a top view of the housing 310 mounted in a wall 332. As shown in this view, the housing 310 has a width Hw and a depth Hd shaped for receipt into the wall 332. The housing 310 is shown positioned between a pair of studs 337 in the wall 332. Mounting brackets 334 are provided on opposite sides of the housing 310 for mounting to the wall 332. The mounting brackets 334 may be an angled member having a housing surface secured to the side of the housing 310. The mounting brackets 334 also have a wall surface positioned on an opposite side of the wall 332 from the lip 317 to pinch the wall 332 therebetween.

The inlet 326 is positioned about a top of the housing 310. The inlet 326 has a rectangular shape having a length Il and a width Iw shaped to receive the plumbing system 103*a* and/or other connections to the various equipment, such as the plumbing and/or condensating equipment 103*b,c* (see, e.g., FIG. 2) and/or the water portion 104*a*1 of the plumbing system 103*a* connected to such equipment 103*b,c*. Each end of the inlet 326 is positioned a distance Id1 from each side of the housing 310 and a distance Id2 from a back of the housing 310. The fluid trigger 212 is shown about the inlet 326 for connection to the equipment 103*b*. The outlet 328 is shown (in hidden line) as a circular member positioned about a bottom of the housing 310 on an opposite location of the housing 310 from the inlet 326.

Figure 3C:
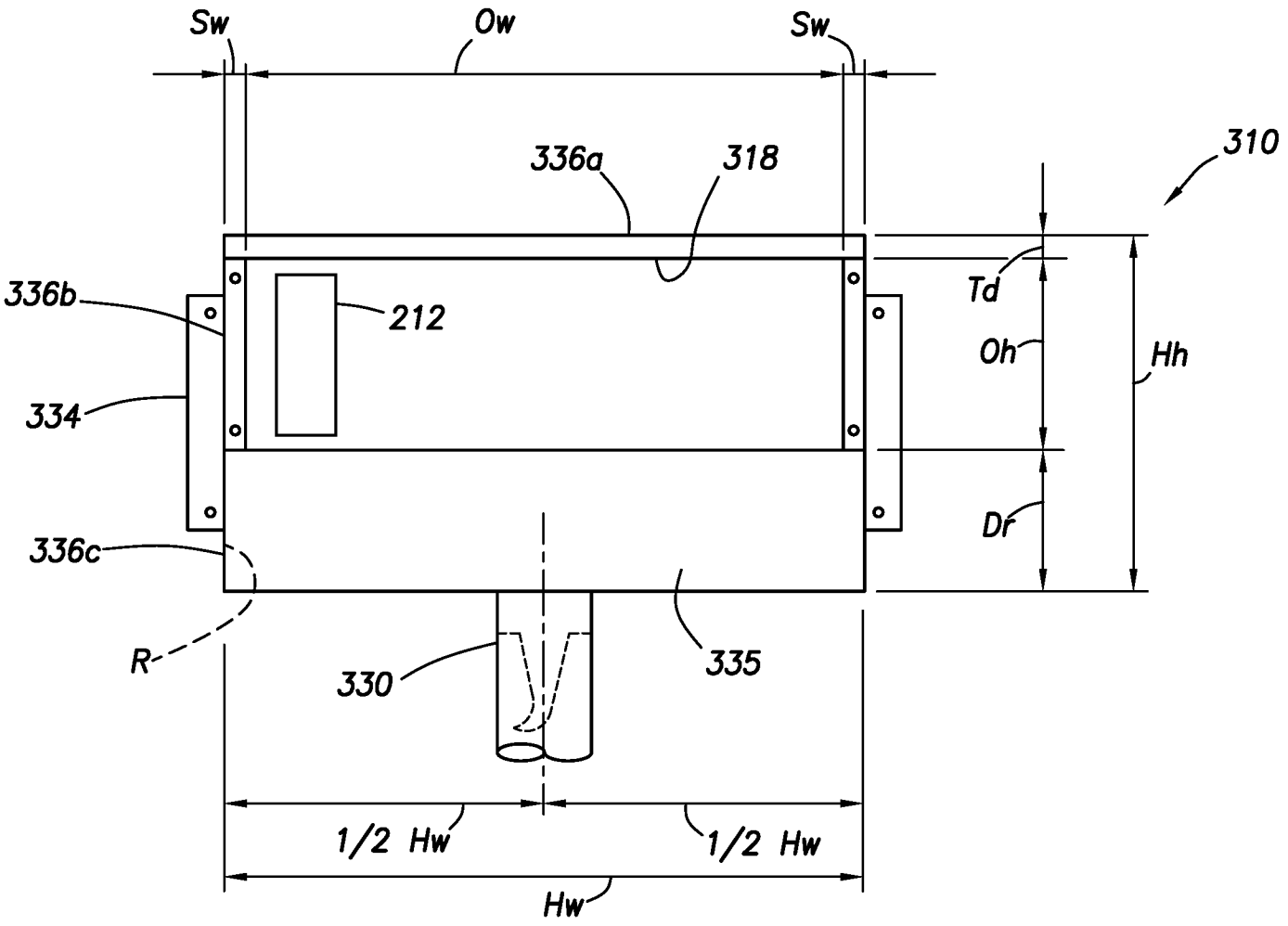

FIG. 3C shows a front view of the housing 310 with the front face 316 and the door 320 removed. The housing 310 has a width Hw and a height Hh. As shown in this view, the front face 316 is removable from the housing 310 to reveal a secondary front 335 of the housing 310. This secondary front 335 includes a top portion 336*a*, side portions 336*b*, and a bottom portion 336*c*. An opening to the chamber 318 is defined between the portions. The opening has a width Ow and a height Oh. The top portion extends a distance Td along the width Hw of the housing. The bottom portion is a rectangular portion having dimensions of the width Hw× the depth Dr of the reservoir R. The side portions extend a width Sw from each side of the housing 310× the opening length Oh extending between the top and the bottom portions.

As also shown in FIG. 3C, the mounting bracket 334 extends from each side of the housing 310 and the outlet 328 extends from the bottom of the housing 310. A center of the tube 330 may be a distance ½Hw from each side of the housing 310. The outlet 328 may be coupled to or include a tube 330 that extends downward from a central location along the bottom of the housing. The tube 330 may also be coupled, to integrally formed, or connected to the housing 310 for connection to the trap assembly 214 as is described further herein.

Figure 4A:
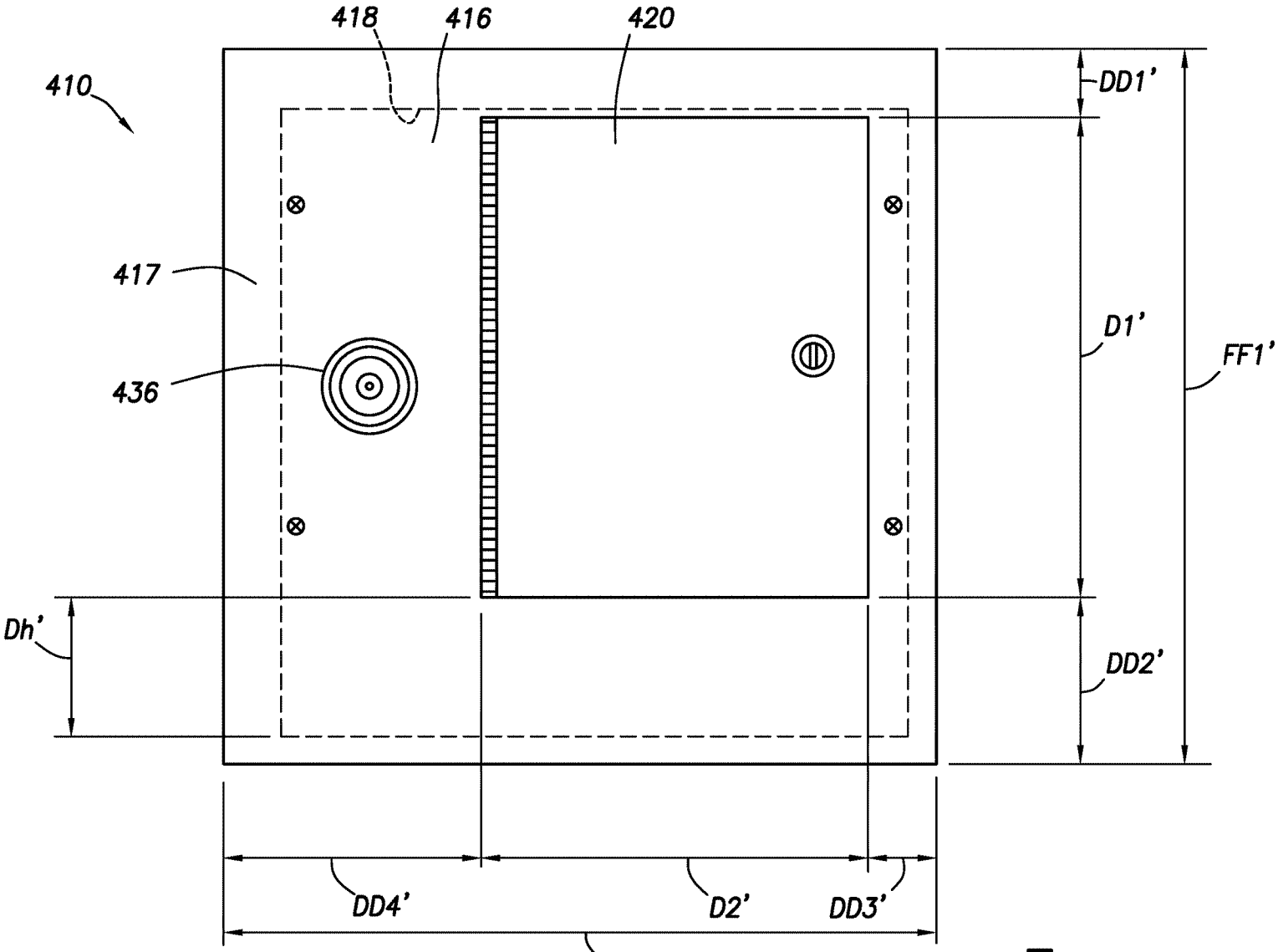
FIGS. 4A-4C are various views of portions of another example contamination unit.
Figure 4B:
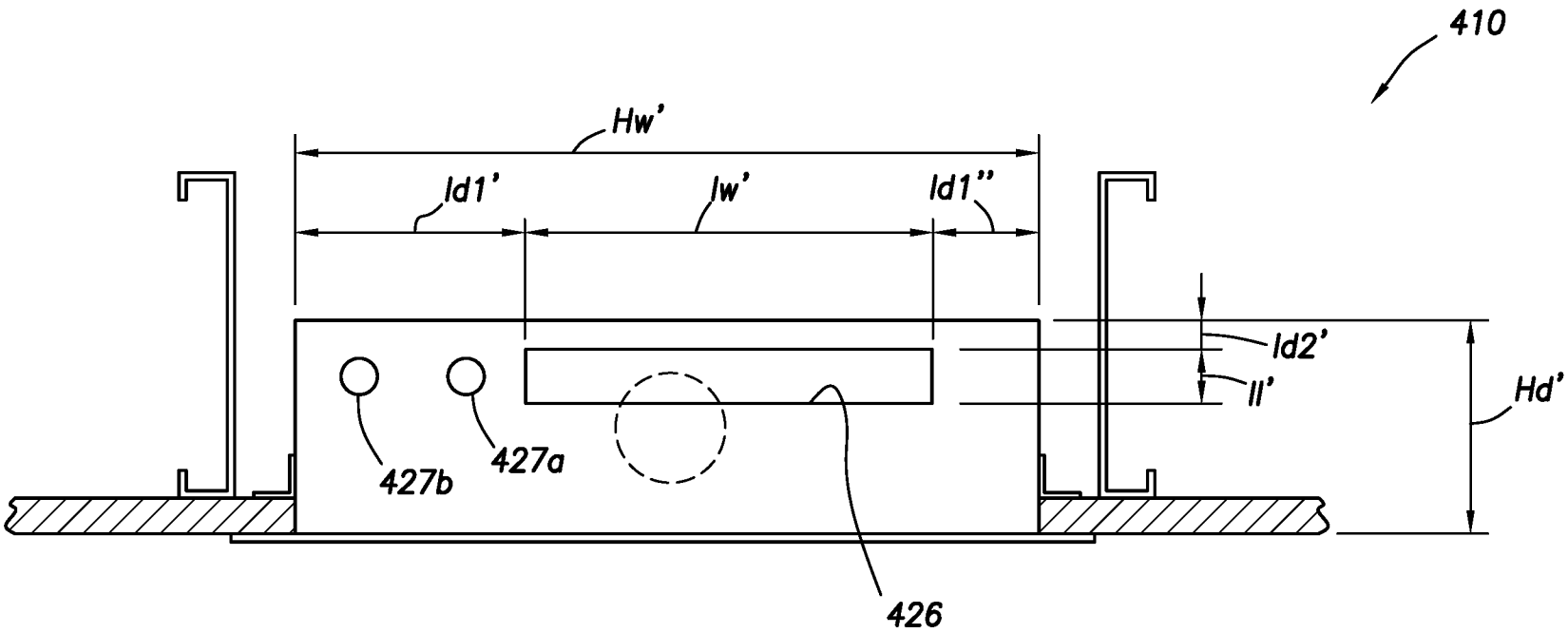
Figure 4C:
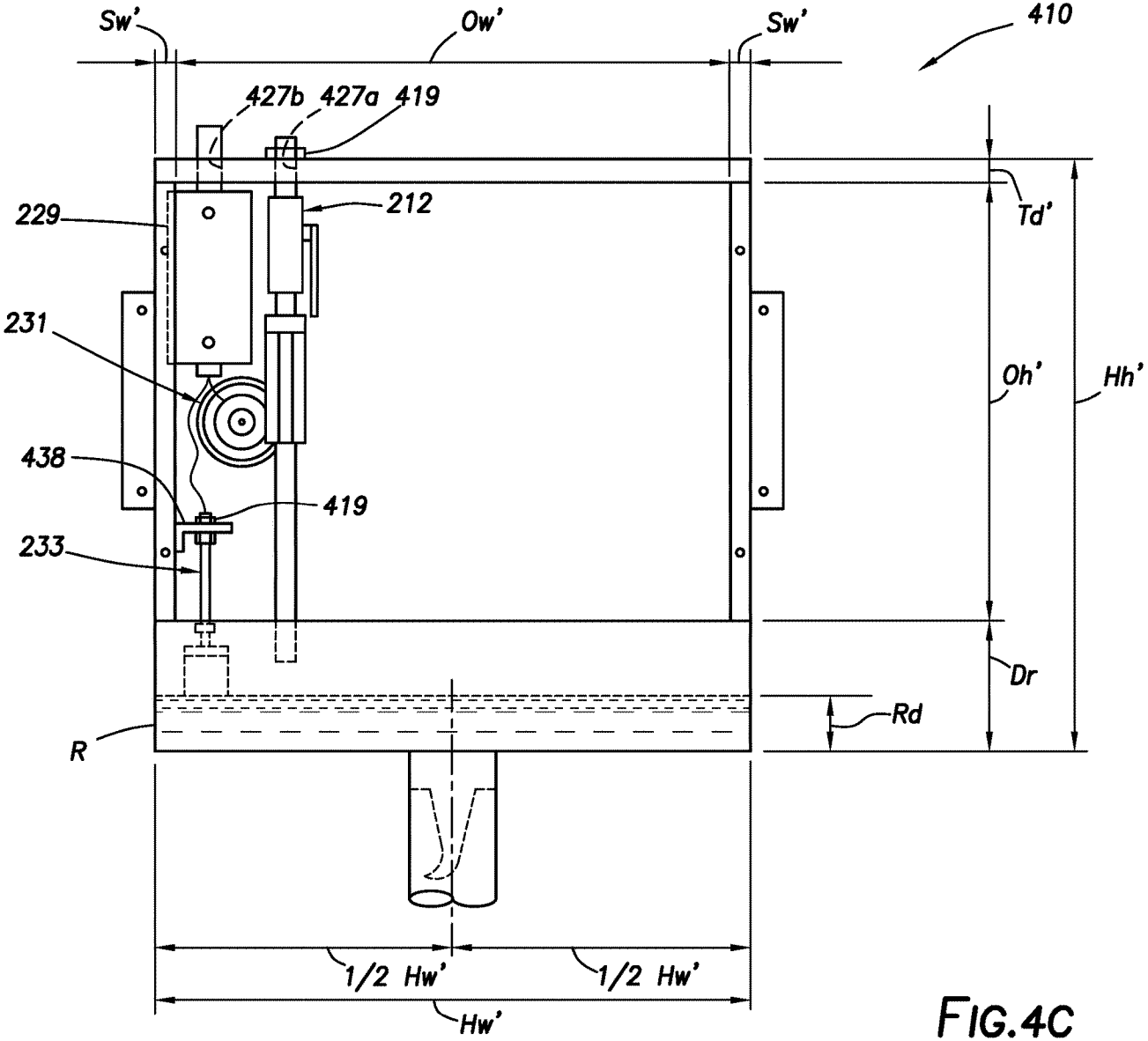

The housings 210, 310, 410 may be provided with various dimensions as shown in Table 1 below:

FIGS. 4A-C show the housing 410 in a second configuration with multiple inlets, a square shape, and several optional features. The housing 410 is similar to the housing 310, except with different dimensions (which may be within the ranges provided in Table 1). As shown in FIG. 4A, the housing 410 has a square shaped body, a square shaped front face 416, and a rectangular door 420.

As shown in FIG. 4A-B, the housing 410 shows dimensions of the front face 416 and the door 420. The front face 416 and the door 420 are similar to the front face 316 and the door 320, except with different dimensions (FF1', FF2', D1', D2', DD1'-DD4', and Dh'). As shown by the dashed line, the front face 416 extends a distance outside the chamber 418 of the housing to define the lip 417 as previously described. This view also shows a cutout 436 for connection to the power/communication equipment 103*d*.

As shown in FIG. 4B, the top of the housing 410 is the same as the housing 310, except that it has different dimensions and inlets 426 and 427*a,b*. The dimensions include Hw', Hd', Id1', Id1', Id2', and Il'. The inlet 426 is similar to the inlet 326, except that it has different width Iw'. The inlets 427*a,b* may be used to connect to various equipment. In this example, the inlet 427*a* may connect to the condensating equipment 103*c* and/or the water portion 104*a*1 of the plumbing system 103*a* connecting to the condensating equipment 103*c*. The inlet 427*b* is depicted as an aperture shaped to receive the power/communication equipment 103*d* and/or connections to such equipment 103*d*.

FIG. 4C shows a front view of the housing 410 with the front face 416 and the door 420 removed. The housing 410 as shown in this view is similar to that of FIG. 3C, except with different dimensions Hw' (and ½Hw'), Hh', opening width Ow', opening height Oh', distance Td', width Sw', and depth of reservoir Rd. The depth Rd may define the amount of fluid used to support the reservoir portion 215*a* of the contamination barrier 211.

As also shown in FIG. 4C, the fluid trigger 212, the power/communications unit 229, the alarm 231, and the sensor 233 may be mounted to the housing 410. The fluid trigger 212 is supported from the top of the housing 410 through the inlet 427*a* and secured by fastener 419. The fluid trigger 212 hangs vertically from the fastener 419 to allow fluid to pass therethrough and into the reservoir R. The power/communications unit 229 is supported from the top of the housing through the inlet 427*b* by a cable connectable to the power/communication equipment 103*d*. The power/communications unit 229 may be mounted (e.g., by bolts, adhesive, etc.) to an inner surface of the side of the housing 410.

The alarm 231 may be supported by the power/communications unit 229 and coupled thereto (e.g., by wiring, cables, etc.) for communication therewith. At least a portion of the alarm 231 may extend through the front face 416 of the housing 410 as shown, for example in FIG. 4A. The alarm 231 may also be coupled to the sensor 233 and/or the power/communications source 104*c* via the power/communications unit 229. The sensor 233 may be vertically supported on the housing 410 by a mounting bracket 438. The mounting bracket 438 may be an L bracket connected to a side of the housing 410 by the fastener 419. The sensor 233 may be positionable in the reservoir R to measure fluid parameters, such as the depth Dr of the fluid in the reservoir R, thereof.

While FIGS. 2-4C show specific configurations of the housing 210, 310, 410, various configurations may be provided. The configurations (e.g., shape, dimensions, etc.) may be defined to provide the contamination barrier 211. These configurations may also be used to support a variety of components, such as the fluid trigger 212, the power/communications unit 229, the alarm 231, and/or other components.

Table 1 shows a chart of some example dimensions that may be used with the housings 210, 310, 410:

TABLE 1

| DIMENSIONS | | | |
|---|---|---|---|
| D1 | 4.56-10.56 in (11.58-26.83 cm) | Iw | 8-12 in (20.32-30.48 cm) |
| D2 | 8.5 in (21.59 cm) | Il | 12 in (30.48 cm) |
| DD1 | 1.5 in (3.81 cm) | Id1 | 0.93-4 in (2.38-10.16 cm) |
| DD2 | 3.75 in (9.53 cm) | Hw | 13.87 in (35.24 cm) |
| DD3 | 1.5 in (3.81 cm) | Hd | 4 in (10.16 cm) |
| DD4 | 5.875 in (14.93 cm) | Ow | 1.875 in (4.76 cm) |
| Dh | 3.06 in (7.78 cm) | Oh | 4.18-10.19 in (10.63-25.88 cm) |
| FF1 | 9.81-15.82 in (24.92-40.17 cm) | Rd | 0-3.0625 in (0-7.78 cm) |
| FF2 | 15.87 in (40.32 cm) | Dr | 3.0625 in (7.78 cm) |
| Td | 0.5 in (1.27 cm) | Sw | 0.5 in (1.27 cm) |

While FIGS. 2-4 and Table 1 show specific dimensions, various dimensions may be provided depending on the application. For example, the housing dimensions may be shaped to fit between the studs 337 of the wall 332. The dimensions as listed give proportions that are about a given dimension, and are not intended to be limit possible dimensions that may be used.

2. The Fluid Trigger

Referring to FIG. 2, the inlets 226*a,b* and/or the water portion 104*a*1 of the plumbing equipment 103*b* may be connectable to the fluid trigger 212. The fluid trigger 212 may be used to pass the fluid from the plumbing equipment 103*b* to the reservoir R, and for use in maintaining the contamination barrier 211. The fluid trigger 212 may be positioned about the inlet 226*a* for connection to the plumbing equipment 103*b* and/or the water portion 104*a*1 of the plumbing system 103*a*. The fluid trigger 212 may be positioned to drop fluid into the reservoir R of the housing.

While the fluid trigger 212 of FIG. 2 is shown fluidly connected to the plumbing equipment 103*b*, one or more fluid triggers may be provided for use with the plumbing equipment 103*b* and/or the condensating equipment 103*c*. The fluid from one or more lines from the water, condensating, and/or plumbing equipment 130*a*-*c* to the housing 210 may pass directly or through the fluid trigger 212 to the reservoir.

Figure 5A:
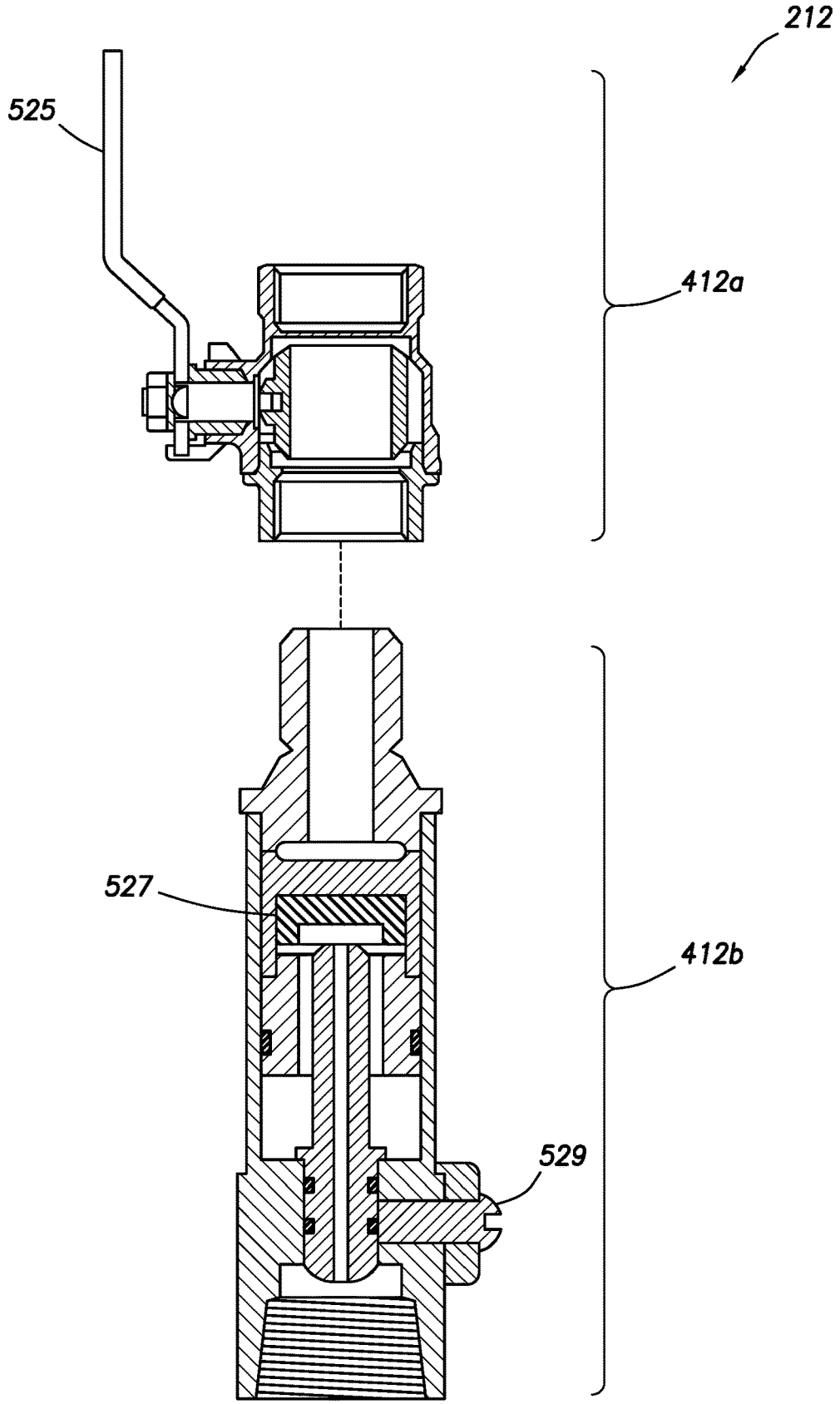
FIGS. 5A and 5B are cross-sectional views of fluid triggers in a primer and a solenoid configuration, respectively.

FIG. 5A shows an example fluid trigger 212 usable in the contamination unit 108 of FIGS. 2-4C. The fluid trigger 212 may include a valve 412*a* and a release 412*b*. As shown by FIGS. 2 and 5A, the valve 412*a* may be fluidly connected (e.g., threadedly connected) to the plumbing equipment 103*b* and/or the water portion 104*a*1 of the plumbing system 103*a* for receiving the fluid therefrom. A handle 525 may be provided for manually activating and/or adjusting the valve 412*a*. The valve 412*a* may be a device that controls flow of the fluid therethrough, such as a gate, needle, butterfly, v-ball, and/or other valve. By way of example, the valve 412*a* may be a ball valve (e.g., quarter turn manual ball valve), such as a lead-free copper alloy ball valve commercially available from KITZ™ at www.kitz.com.

The release 412*b* may be fluidly connected to the valve 412*a* to receive the fluid therefrom. The release 412*b* may selectively pass the fluid from the valve 412*a* into the reservoir R of the housing 210. By way of example, the release 412*b* may be a primer, such as a pressure drop activated trap primer commercially available from PRECISION PLUMBING PRODUCTS™ at www.pppinc.net.

The release 412*b* may be a pressure driven device that releases the fluid upon application of a predetermine pressure. For example, upon a change (e.g., decrease) in pressure (e.g., due to activity of the plumbing equipment 103*b*, an intake of the fluid trigger 212 experiences a vacuum. This vacuum may actuate an internal diaphragm 527 (e.g., rubber valve) to shift to allow fluid to flow out of the fluid trigger 212. In another example, upon an increase in pressure, the internal diaphragm may actuate to prevent backflow through the fluid trigger 212. An adjustable key 529 may be provided in the fluid trigger 212 to allow adjustability of the diaphragm and/or pressures causing the activations.

The fluid trigger 212 may be self-activated by a reduction of the pressure in the fluid source 104*a* and/or the plumbing equipment 103*b*. A reduction in pressure in the fluid source 104*a* can be caused by, for example, fluid being utilized by plumbing equipment 103*b*, such as a toilet flushing, and/or the condensating equipment 103*c*, such as use of air conditioning. Such reduction in pressure may cause the release 412*b* to allow fluid to pass therethrough. The fluid trigger 212 may also be activated by the power/communications unit 229 due to a signal from the sensor 233 as is described further herein.

Figure 5B:
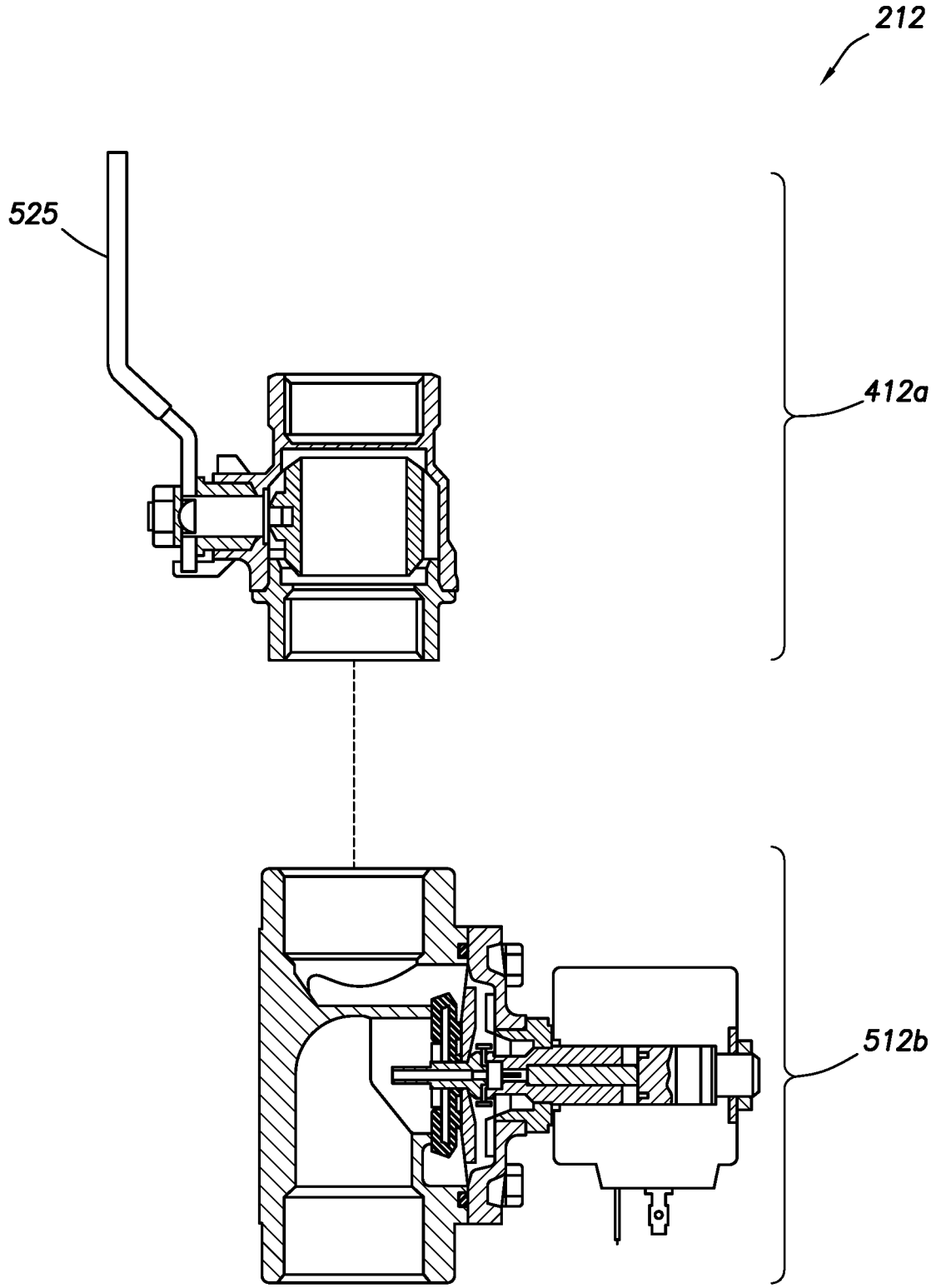

FIG. 5B shows another version of the fluid trigger 212 in a solenoid configuration. This version is similar to the fluid trigger 212 of FIG. 5A, except that it has a solenoid valve 512*b* connected to the valve 412*a*. The solenoid valve 512*b* may be one, for example, commercially available from GRAINGER™ at www.grainger.com. The solenoid valve 512*b* may include or be connected to a solenoid valve connector, pipes, or the like. The solenoid valve 512*b* may be fluidly connected to the valve 412*a* to receive the fluid therefrom. The solenoid valve 512*b* may have various configurations including, for example, a valve, connectors, and/or other features.

The solenoid valve 512*b* may selectively release fluid into the reservoir R according to predefined time intervals and/or based on measurements by the fluid sensor 233. The solenoid valve 512*b* may be defined to release according to a time interval for a defined time duration. The power/communication equipment 103*d* may be programmed to this defined time, such as for the duration of about one minute.

The power/communication equipment 103*d* may also be programmed to deactivate the solenoid valve 512*b* in response to the fluid sensor 233. For example, based on the measurements of the fluid sensor 233 (e.g., an undesirable level in reservoir R), the power/communication equipment 103*d* may override the defined time and prevent the solenoid valve 512*b* from releasing fluid.

3. The Trap Assembly

Referring back to FIG. 2, the fluid in the reservoir R passes through the housing 210 and the trap assembly 214, and on to the sewer 104*b*. The trap assembly 214 may be shaped to permit fluid to pass from the reservoir R, through the outlet 228, through the trap assembly 214, and to the sewer portion 104*a*2 of the plumbing system 103*a* and/or the sewer 104*b* for passing the fluid therethrough. The outlet 228 of the housing 210 may be fluidly connected to the sewer 104*b* by the trap assembly 214. The outlet 228 may be in the form of an opening and/or the tube 230 positioned about the bottom of the housing 210 to release the fluid from the reservoir R for passage to the sewer 104*b*.

The outlet 228 and/or the tube 230 of the housing 210 may be connected to or integral with an upstream end of the trap assembly 214. A downstream end of the trap assembly 214 may be fluidly connected to the sewer 104*b*. The downstream end of the trap assembly 214 may be connected directly or via the plumbing system 103*a* to the sewer 104*b* for passing the fluid from the contamination unit 108 to the sewer 104*b*.

Figure 6B:
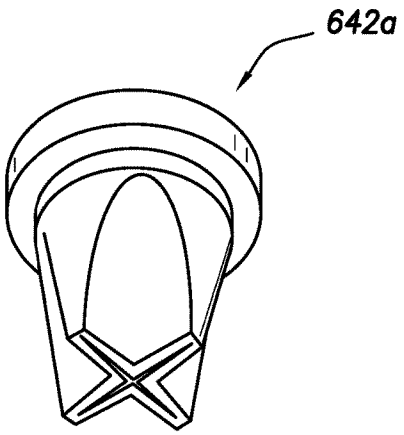
FIG. 6B is a perspective view of a trap.
Figure 6A:
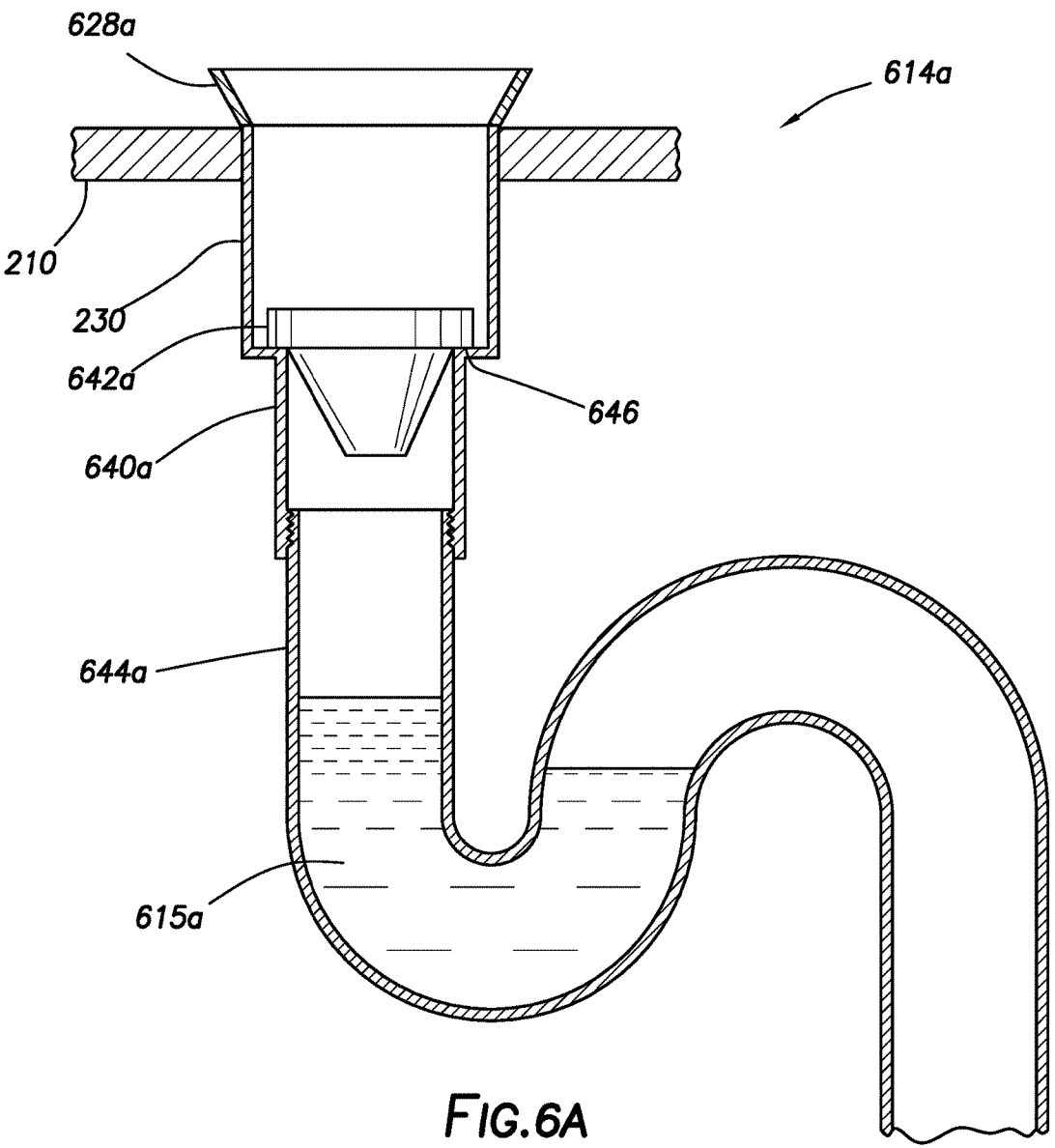
FIG. 6A is a partial, cross-sectional view of an example trap assembly.
Figure 6C:
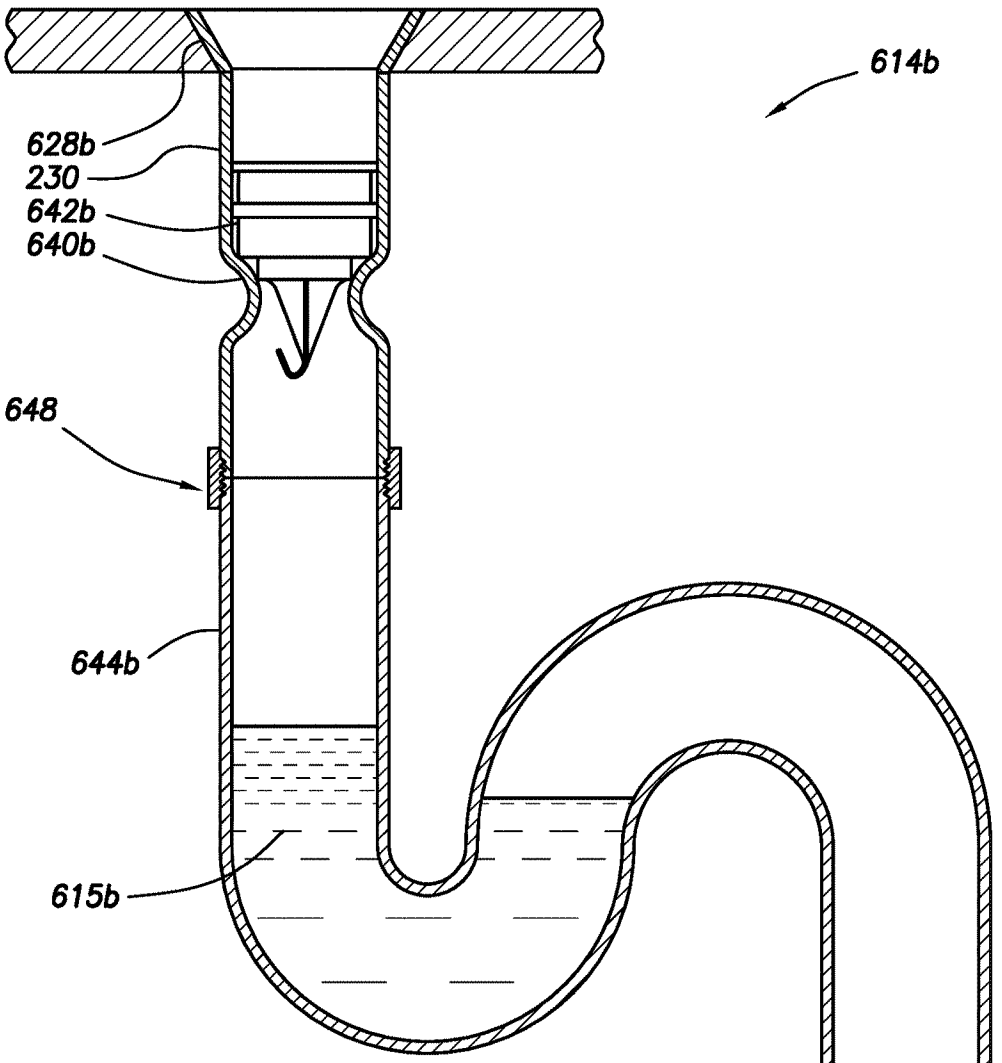
FIG. 6C is a partial, cross-sectional view of another example trap assembly.

FIGS. 6A and 6C show example trap assemblies 614*a,b* usable in the contamination unit 108. The trap assemblies 614*a,b* are shown positioned in a bottom portion of the housing 210 about the opening 628*a,b*. The opening 628*a,b* is depicted as funnel shaped drain positioned about a bottom of the housing 210 for allowing fluid in the reservoir R to fall into the trap assembly 214.

In the example of FIG. 6A, the opening 628*a* is integral with the tube 230 to define a raised drain extending a distance above the bottom of the housing 210. In the example of FIG. 6C, the opening is a funnel shaped drain flush with the bottom of the housing 210 and separate from the tube 230 extending below the housing 210. As shown by these examples, the outlet 228, 628,*a,b* may have various configurations to allow fluid from the reservoir to pass into the trap assembly 214.

The trap assembly 214 includes a trap seat 640*a,b*, a trap 642*a,b*, and a trap conduit 644*a,b*. The trap seat 640*a,b* may be a tubular member connectable (e.g., threadedly) to the outlet 228 and/or the tube 230. The trap seat 640*a,b* may be, for example, a pipe with a step down inner surface, which may be positioned within a strap, a bracket, a groove stopper, a collar, etc. The trap seat 640*a,b* may have a stepped inner surface defining a trap support 646 for receivingly supporting the trap 642*a,b* therein. The trap seat 640*a,b* may sealingly engage the trap 642*a,b* to form a seal thereabout to prevent passage of the fluid between the trap seat 640*a,b* and the trap 642*a,b*.

As shown in FIG. 6A, the trap seat 640*a* may be integral with the outlet 228 and the tube 230. As also shown by FIG. 6A, the trap seat 640*a* may be directly connected to the trap conduit 644*a*. As shown in FIG. 6C, the trap seat 640*b* may be a dimple extending into the tube 230 about the trap 642*b*. The tube 230 with the dimple may be, for example, a groove coupling commercially available from VICTAULIC™ at www.victaulic.com. As also shown by FIG. 6C, the trap seat 640*b* may be connected to the trap conduit 644*a,b* by one or more collars 648. Various combinations of integral and/or separate components may be provided.

The trap seat 640*a,b* may be shaped to support a variety of traps. As shown in FIG. 6A, the trap 642*a* is a rubber, circular member with a cross shaped exit port extending therebelow. As shown in FIG. 6C, the trap 642*b* is a rubber, circular member with a curled shaped exit port extending therebelow. The trap 642*a,b* may be any trap or valve capable of allowing fluid to pass down through the trap assembly 214, and prevents backflow therethrough. Examples of traps that may be used include QUAD CLOSE™ commercially available from www.jrsmith.com and TRAP GUARD™ commercially available from www.proventsystems.com as shown in FIG. 6B.

As shown by FIGS. 6A and 6C various dimensions of the trap conduit 644*a,b* may be provided. The trap assembly 214 may include one or more tubular members (e.g., pipes, conduits, tubes, etc.) and/or other member made of plastic, metal, or other material capable of passing fluid therethrough and connecting to other parts of the contamination system 106.

The trap conduit 644*a,b* may be a tubular member having a non-linear shape, such as the S shaped curve shown in FIGS. 6A and 6C. The tubular conduit 644*a,b* may have a shape configured to maintain the fluid therein to define the trap portion 615*a,b* of the contamination barrier 211 to prevent sewage from passing therethrough. While not shown, other variations in the shape of the conduit 644*a,b* may be provided to enable collection of the fluid to form the trap portion 615*a,b* in the trap assembly 614*a,b*. For example, one or more rising and/or falling portions of the tubular conduit 644*a,b* may be provided to define one or more of the trap portions 615*a,b*.

Referring back to FIG. 2, the trap assembly 214 may be used with the housing 210 to collect fluid from the plumbing equipment 103*b* and the condensating equipment 103*c* to form redundant portions of the contamination barrier 211 (i.e., to for a redundant contamination barrier). Specifically, the contamination barrier 211 may include a first of the redundant portions provided by the reservoir portion 215*a* defined by the fluid in the reservoir R, and a second of the redundant portions provided by the trap portion 215*b* defined by the trap assembly 214, thus creating what may be referred to as a redundant contamination barrier. A portion of the fluid may remain in the trap assembly 614*a,b* to provide the trap portion 215*b*, and the remaining may pass to the sewer 104*b*.

The trap portion 215*b* of the contamination barrier 211 is shown as being at a minimum level sufficient to block passage of the gas from the sewer 104*b* therethrough. Should the fluid in the trap portion 215*b* fall further, the sewage from the sewer 104*b* may pass through the trap assembly 214 and back to the housing 210. The fluid in the reservoir R is at a depth Dr sufficient to maintain fluid for the portions 215*a* and/or 215*b*. In examples of the disclosed redundant contamination barrier, such as contamination barrier 211, the portions 215*a,b* provide redundant barriers to prevent passage of the sewage from the sewer 104*b* back to the operational region 209*a*. The portions 215*a,b* may be maintained at a minimum level by selective activation of the fluid trigger 212.

The fluid trigger 212 may also be selectively activated to protect the trap 642*a,b*. Should the trap assembly 214 (and/or other items downstream thereof) become clogged, a snake or other tool may be passed through the trap 642*a,b* to remove clogs therein. A regular or continuous flow of fluid through the trap 642*a,b* may be used to prevent such clogs and/or to increase the durability of the trap 642*a,b*. For example, a rubber trap may require regular moisture to prevent cracking, loss of seal, and/or failure, and to prevent clogging which may damage the trap 642*a,b*. The fluid trigger 212 may be selectively activated to provide fluid as needed by the trap 642*a,b*.

4. The Power/Communication Unit

Referring back to FIG. 2, the contamination unit 108 may be provided with other features, such as the power/communication unit 229, the alarm 231, the sensor 233, the fluid trigger 212, and/or other devices. These devices may be coupled to the power/communication equipment 103*d* and/or the power/communication source 104*c* for operation therewith. The power/communication unit 229 may include electrical circuitry (e.g., power supplies, batteries, solar panels, etc.) capable of providing power to the alarm 231, the sensor 233, the fluid trigger 212, and/or other components of the contamination system 106. This circuitry may transfer power from the power/communication unit 229 to such components via wired and/or wireless connections.

The circuitry of the power/communication unit 229 may also have components, such as logic, processors, databases, transceivers, etc., or be connectable to such components in the power/communication unit 229 to pass data and/or communication signals therebetween. For example, the power/communication unit 229 may receive data from the sensor 233 and send a signal to the alarm 231. In this manner, the alarm 231 may be conditionally activated upon detection of certain of the fluid parameters from the sensor 233.

The alarm 231 may be supported by the power/communications unit 229 and coupled thereto (e.g., by wireless connection, wiring, cables, etc.) for communication therewith. The alarm 231 may also be wired and/or wirelessly coupled to the sensor 233, the power/communications unit 229, the power/communications equipment 103*d*, the power/communications source 104*c*, and/or other receivers via the circuitry. The alarm 231 may be a light, sound, signal, vibration, scent, and/or other means for alert. The alarm 231 may have an indicator (e.g., light) positioned through the housing 210 for visual contact with operators. Examples of alarms that may be used include a horn commercially available from EDWARDS SIGNALING™ at www.edwards-signals.com.

Figure 7:
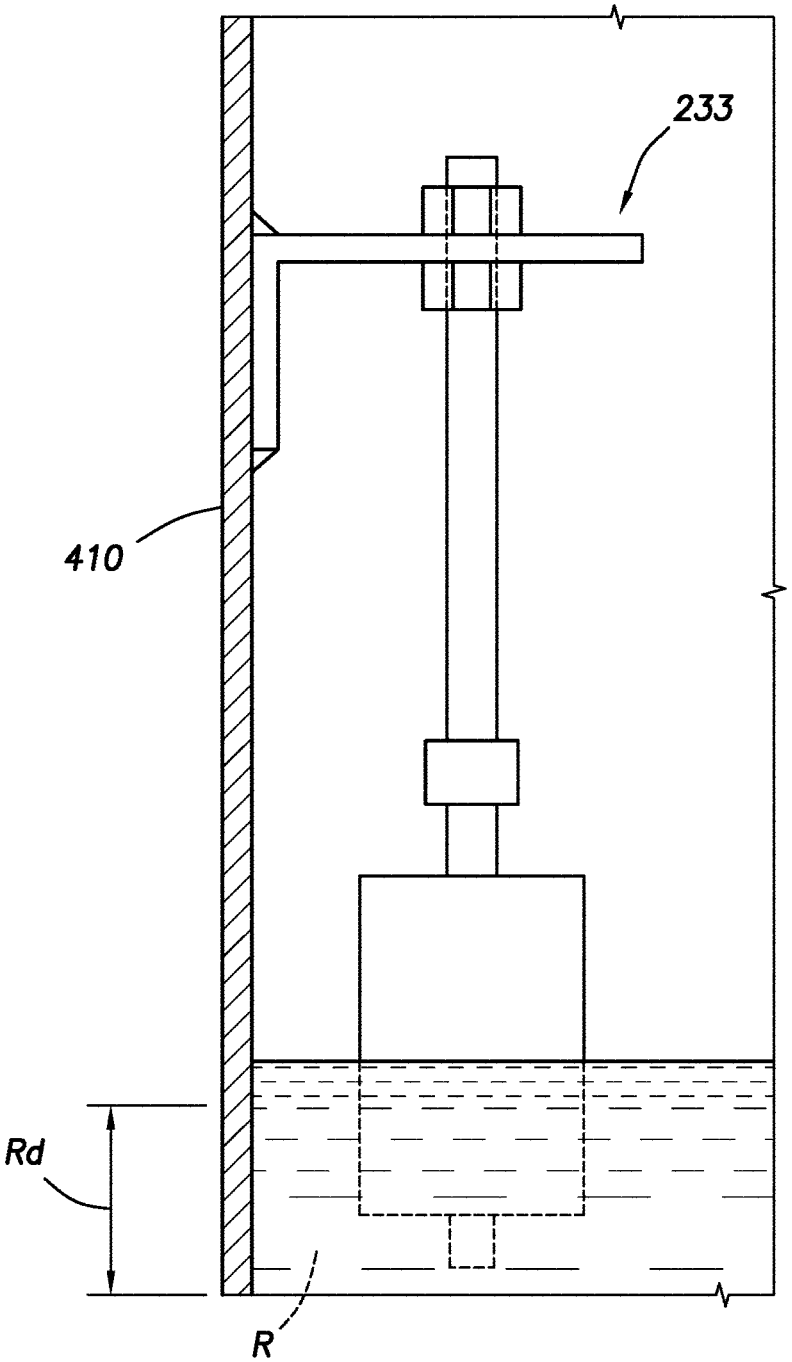
FIG. 7 is a detailed view of a portion of the contamination unit depicting a fluid sensor.

The sensor 233 may be a fluid sensor connectable to the power/communications unit 229 to measure the fluid parameters. As shown in FIGS. 4C and 7, the sensor 233 may be supported in the housing 410 and positioned for contact with the fluid in the reservoir R to determine, for example, the depth Rd defining the reservoir portion 215*a* of the contamination barrier 211. The sensor 233 may capture depth and other fluid data, and send this data to the power/communication unit 229.

Upon detection of an undesired fluid level within the reservoir R, the alarm 231 may be triggered via the power/communications unit 229. For example, as the depth Rd falls below the minimum level necessary to maintain the portions 215*a* and/or 215*b*, the circuitry may be activated to send the signal to the alarm 231. The circuitry may send a signal to the fluid trigger 212, the plumbing equipment 103*b*, the condensating equipment 103*c*, and/or to an operator to release fluid to fill the reservoir R. In another example, the depth Rd may fall above a maximum level defined by the depth Dr of the reservoir R which may cause fluid to spill out of the housing 210. The circuitry may send the signal to the alarm 231 to alert an operator.

The fluid sensor 233 may be a float switch or other sensor capable of measuring fluid parameters of the reservoir. An example of a float switch that may be used is commercially available from SMD FLUID CONTROLS™ at www.fluid-switch.com. While a fluid sensor 233 is depicted for monitoring the fluid in the reservoir R, other sensors may be provided about the contamination system 106. One or more various types of sensors, such as ultrasonic, radar, nuclear, magnetic, etc., may be provided to various aspects of the contamination system 106, such as quantities of fluid passing from the equipment 103*b,c* and/or to the sewer 104*b*.

The above description is illustrative of the preferred embodiment and many modifications may be made by those skilled in the art without departing from the disclosure whose scope is to be determined from the literal and equivalent scope of the claims that follow.

While the embodiments are described with reference to various implementations and exploitations, it will be understood that these embodiments are illustrative and that the scope of the inventive subject matter is not limited to them. Many variations, modifications, additions and improvements are possible, such as various combinations of the features and/or methods described herein.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Insofar as the description above and the accompanying drawings disclose any additional subject matter that is not within the scope of the claim(s) herein, the disclosed features are not dedicated to the public and the right to file one or more applications to claim such additional features is reserved. Although a very narrow claim may be presented herein, it should be recognized the scope of this disclosure is much broader than presented by the claim(s). Broader claims may be submitted in an application that claims the benefit of priority from this application.

What is claimed is:

1. A contamination unit for isolating a building from contamination of a sewer, the building comprising plumbing equipment and condensating equipment, each of the plumbing equipment and the condensating equipment in fluid communication with a fluid source to receive a fluid therefrom, the contamination unit comprising:

a housing having at least one inlet and at least one outlet, the at least one inlet in fluid communication with at least one of the fluid source, the plumbing equipment, and the condensating equipment to receive the fluid therefrom, the housing having a reservoir to collect a first portion of the fluid therein, the first portion of the fluid defining a reservoir portion of a redundant contamination barrier about the at least one outlet;

a trap assembly comprising a trap conduit, the trap conduit operatively connected between the at least one outlet and the sewer to pass the fluid from the housing to the sewer, the trap conduit having a deviation shaped to collect a second portion of the fluid therein, the second portion of the fluid defining a trap portion of the redundant contamination barrier to the sewer, the reservoir portion and the trap portion isolated from each other to form the redundant contamination barrier to isolate the building from contamination of the sewer; and a fluid trigger positionable about the housing to selectively release the fluid from the fluid source, through the at least one inlet, and into the reservoir of the housing whereby the fluid in the reservoir portion of the redundant contamination barrier is maintained to prevent, upon contamination past the trap portion, the contamination of the sewer from passing from the sewer into the building.

2. The contamination unit of claim 1, wherein the at least one inlet comprises:

a water inlet operatively connected to at least one of the fluid source and the plumbing equipment; and a condensation inlet operatively connected to the condensating equipment.

3. The contamination unit of claim 1, further comprising a fluid sensor positionable about the reservoir to measure fluid parameters thereof.

4. The contamination unit of claim 3, further comprising a power/communication unit operatively coupled to the fluid sensor to receive the fluid parameters therefrom and to the fluid trigger, the power/communication unit comprising a processor to selectively activate the fluid trigger to release the fluid based on the fluid parameters.

5. The contamination unit of claim 1, further comprising a power/communication unit supported in the housing, the power/communication unit operatively connected to the fluid trigger to send activation signals thereto.

6. The contamination unit of claim 5, wherein the fluid trigger comprises at least one of a solenoid and a primer.

7. The contamination unit of claim 1, further comprising a power/communication unit supported in the housing, the power/communication unit operatively connected to at least one of power/communication equipment of the building and a power/communication source.

8. The contamination unit of claim 7, further comprising an alarm operatively connected to the power/communication unit.

9. The contamination unit of claim 1, wherein the trap assembly further comprises a trap positioned in the trap conduit.

10. The contamination unit of claim 9, wherein the trap assembly further comprises a trap seat shaped to sealingly support the trap therein.

11. The contamination unit of claim 10, wherein the trap seat comprises one of a shoulder and a dimple.

12. The contamination unit of claim 1, wherein the contamination unit is operatively connectable to at least one of the sewer, the plumbing equipment, the fluid source, and the condensating equipment by portions of a plumbing system.

13. The contamination unit of claim 1, wherein the housing comprises a front plate with an access door.

14. A contamination system for isolating a building from contamination of a sewer, the building comprising plumbing, condensating, and power/communication equipment, each of the plumbing equipment and the condensating equipment in fluid communication with a fluid source to receive a fluid therefrom, the contamination system comprising:

a plurality of contamination units, including a first contamination unit, each of the plurality of contamination units comprising:

a housing having at least one inlet and at least one outlet, the at least one inlet in fluid communication with at least one of the fluid source, the plumbing equipment, and the condensating equipment to receive the fluid therefrom, the housing having a reservoir to collect a first portion of the fluid therein, the first portion of the fluid defining a reservoir portion of a redundant contamination barrier about the at least one outlet;

a trap assembly comprising a trap conduit, the trap conduit operatively connected between the at least one outlet and the sewer to pass the fluid from the housing to the sewer, the trap conduit having a deviation shaped to collect a second portion of the fluid therein, the second portion of the fluid defining a trap portion of the redundant contamination barrier to the sewer, the reservoir portion and the trap portion isolated from each other to form the redundant contamination barrier to isolate the building from contamination of the sewer; and a fluid trigger positionable about the housing to selectively release the fluid through the at least one inlet and into the reservoir of the housing to maintain fluid in the reservoir portion of the redundant contamination barrier; and a power/communication unit communicatively coupled to the plurality of contamination units to selectively signal a first fluid trigger of the first contamination unit whereby the fluid in the redundant contamination barrier of the first contamination unit is maintained to prevent, upon contamination past the trap portion of the first contamination unit, the contamination of the sewer from passing through the first contamination unit from the sewer into the building.

15. The contamination system of claim 14, wherein the power/communication unit is communicatively coupled to the power/communication equipment of the building.

16. The contamination system of claim 15, further comprising a fluid sensor positionable in the reservoir, the power/communication unit coupled to the fluid sensor to receive fluid parameters therefrom.

17. A method of isolating a building from contamination of a sewer, the building having building facilities comprising a fluid source, plumbing equipment, and condensing equipment, the method comprising:

positioning contamination units about a building, the contamination units comprising a housing with a reservoir and a trap assembly with a deviation, the reservoir forming a first barrier of a redundant contamination barrier, the deviation forming a second barrier of the redundant contamination barrier;

selectively passing fluid from the building facilities through the housing and the trap of the contamination units, and to a sewer; and inhibiting contamination from passing from the sewer back into the building through the contamination units by defining the redundant contamination barrier by collecting a first portion of the fluid in the reservoir of the housing and a second portion of the fluid in the deviation of the trap assembly, wherein the first barrier remains operational independently of the second barrier remaining operational.

18. The method of claim 17, further comprising measuring fluid parameters of the fluid in the reservoir.

19. The method of claim 18, further comprising maintaining the redundant contamination barrier by performing the selectively passing based on the measured parameters.

20. The method of claim 17, wherein the selectively passing comprises releasing the fluid according to predefined time intervals.

* * * * *